US006461190B1

(12) United States Patent
Boulay et al.

(10) Patent No.: US 6,461,190 B1
(45) Date of Patent: Oct. 8, 2002

(54) CONNECTOR FOR AN ELECTRICAL APPLIANCE, AND A CHARGER COMPRISING SUCH A CONNECTOR

(75) Inventors: Philippe Boulay, Bazougers; Luc Pierart, Paris, both of (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/689,888

(22) Filed: Oct. 13, 2000

(30) Foreign Application Priority Data

Oct. 25, 1999 (FR) ..... 99 13264

(51) Int. Cl.[7] ..... H01R 13/72
(52) U.S. Cl. ..... 439/501
(58) Field of Search ..... 439/501, 502; 249/52; 24/130, 115 R; 191/12.4

(56) References Cited

U.S. PATENT DOCUMENTS

| | | | | |
|---|---|---|---|---|
| 2,292,140 A | | 8/1942 | Lofgren | |
| 2,438,143 A | * | 3/1948 | Brown | 439/160 |
| 2,476,735 A | * | 7/1949 | Johnson | 439/160 |
| 2,521,226 A | * | 9/1950 | Keller | 439/501 |
| 2,977,564 A | * | 3/1961 | Civitelli et al. | 439/160 |
| 3,008,115 A | * | 11/1961 | Oakes | 439/160 |
| 4,067,526 A | * | 1/1978 | Storer | 439/501 |
| 4,213,546 A | * | 7/1980 | Massey | 222/546 |
| 4,406,042 A | * | 9/1983 | McPhee | 24/130 |
| 5,024,402 A | | 6/1991 | Hamel | |
| 5,062,803 A | * | 11/1991 | Howard et al. | 439/160 |
| D323,103 S | * | 1/1992 | Hilmersson et al. | D8/356 |
| 5,507,667 A | | 4/1996 | Hahn et al. | |
| 5,535,970 A | * | 7/1996 | Gobbi | 248/74.2 |
| 5,577,932 A | * | 11/1996 | Palmer | 439/501 |
| 5,720,628 A | | 2/1998 | Usui et al. | |
| 5,771,471 A | * | 6/1998 | Alberth, Jr. et al. | 455/573 |
| 5,810,825 A | * | 9/1998 | Huebner | 606/74 |
| 5,939,860 A | * | 8/1999 | William | 320/114 |
| 5,967,807 A | * | 10/1999 | Wu | 439/131 |
| 6,047,572 A | * | 4/2000 | Bliven | 70/58 |
| 6,049,701 A | * | 4/2000 | Sparksman | 455/74.1 |
| D425,480 S | * | 5/2000 | Jokinen | D13/107 |
| 6,099,341 A | * | 8/2000 | Shymko | 439/371 |
| 6,126,460 A | * | 10/2000 | Wu | 439/131 |
| 6,152,060 A | * | 11/2000 | Steiner | 114/219 |

FOREIGN PATENT DOCUMENTS

| | | |
|---|---|---|
| DE | 1 920 063 U | 7/1965 |
| WO | WO 97/21391 A | 6/1997 |

* cited by examiner

*Primary Examiner*—Neil Abrams
*Assistant Examiner*—Javaid Nasri
(74) *Attorney, Agent, or Firm*—Sughrue Mion, PLLC

(57) ABSTRACT

The present invention relates to a connector for an electrical appliance, the connector comprising a housing supporting at least a pair of male pins designed to be electrically connected to conductive wires of a female socket, and a power cable. In the invention, said connector carries fixing means for fixing the power cable, which fixing means are suitable for receiving at least one of said male pins when the connector is in a storage position. Application in particular to mobile-telephone chargers.

15 Claims, 4 Drawing Sheets

CONNECTOR FOR AN ELECTRICAL APPLIANCE, AND A CHARGER COMPRISING SUCH A CONNECTOR

The present invention relates to a connector for an electrical appliance, and relates more particularly to the problem of storing and/or transporting such a connector when it is not in use.

BACKGROUND OF THE INVENTION

A non-limiting application typically illustrating the above-mentioned problem is the connector equipping a charger for a radio-communication terminal. The charger conventionally comprises a housing supporting at least a pair of male pins designed to be electrically connected to conductive wires of a female socket (main outlet), and a power cable. The charger also comprises electrical contact means situated at that end of the power cable which is remote from the end fixed to the housing, to make an electrical connection between the cable and the radio-communication terminal. With simple chargers, the electrical contact means are constituted by a plug. With charges of the desk-charger type, the electrical contact means also have the function of supporting the radio-communication terminal in an almost vertical position.

Although radio-communication terminals have ever-increasing battery charge lifetime, it remains desirable to be able to carry the charger with them, in particular for trips lasting several days. To save space, the user generally winds the power cable around the housing of the connector. The end of the power cable remote from the end fixed to the housing is then either trapped, if possible, under one of the last turns, if the charger is a simple charger, or, if it is a desk charger, it is left dangling from the housing.

In the first case, the winding is not very reliable and there is a risk of the power cable being damaged. In the second case, the cable can easily unwind.

Furthermore, the problem of storage and transport also exists when the charger is manufactured. Usually, the power cable is wound up after the charger has been manufactured, and it is kept wound up by means of a quick fastener that is attached by the manufacturer. The quick fastener is generally constituted by a small wire made of plastics material that is twisted around the wound cable. In any event, such a fastener is unsuitable for fastener attachment to be automated. Furthermore, once the user has unpacked the charger for the first time, the fastener is generally lost forever.

OBJECT AND SUMMARY OF THE INVENTION

The object of the present invention is to mitigate the above-mentioned drawbacks.

This object is achieved by means of a connector for an electrical appliance, the connector comprising a housing supporting at least a pair of male pins designed to be electrically connected to conductive wires of a female socket, and a power cable, the connector carrying fixing means for fixing the power cable, which fixing means are suitable for receiving at least one of said male pins when the connector is in a storage position.

The present invention also provides a charger for a radio-communication terminal, the charger comprising the connector of the invention, and electrical contact means situated at that end of said power cable which is remote from said housing, to make electrical contact between said power cable and the radio-communication terminal, wherein said fixing means form an integral part of said electrical contact means.

BRIEF DESCRIPTION OF THE DRAWINGS

The invention will be better understood on reading the following description, given by way of non-limiting example and with reference to the accompanying drawings, in which.

MORE DETAILED DESCRIPTION

Figure 1A:
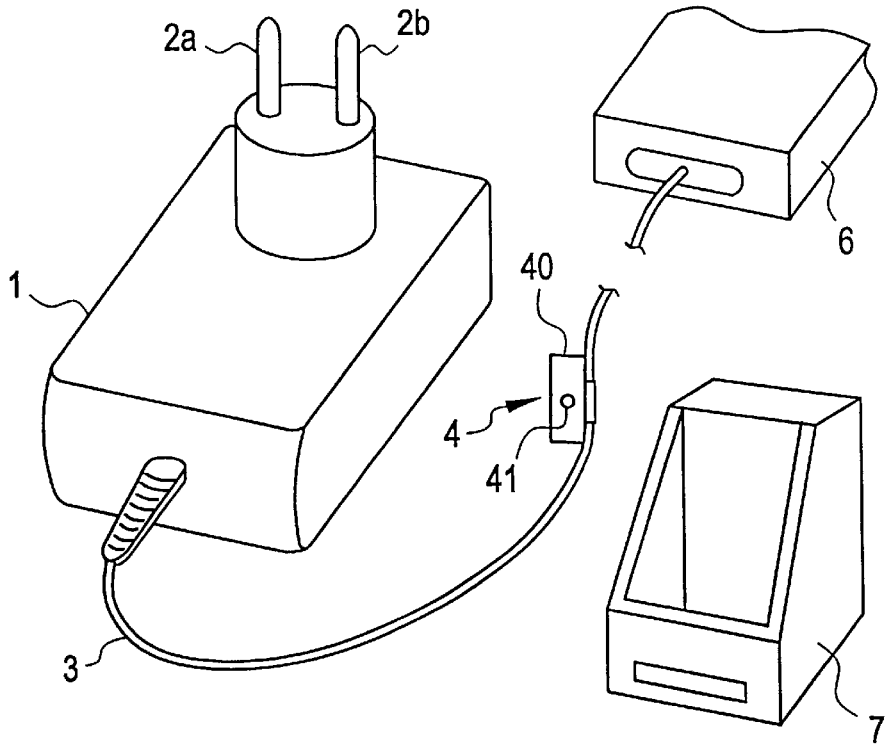
FIG. 1*a* shows a first embodiment of a connector of the invention, in which the connector is in a working position.

The various figures show a connector comprising a housing 1 supporting at least two male pins 2*a*, 2*b*, and a power cable 3. As specified above for a radio-communication terminal charger, one end of the cable either carries a plug for electrical connection to a radio-communication terminal 6, or it is connected to electrical contact means 7 which also act as support means for the radio-communication terminal. FIG. 1*a* illustrates an example where the end of the cable 3 is connected to the radio-communication terminal 6. However, it is understood that this end of the cable can also be attached to the electrical contact means 7 or other electrical devices.

In the invention, the connector also comprises fixing means 4 enabling the power cable to be fixed to at least one of the two pins in a storage position of the connector. The cable is preferably wound around the housing beforehand, as shown in FIGS. 1*b* and 2*b*.

Figure 1B:
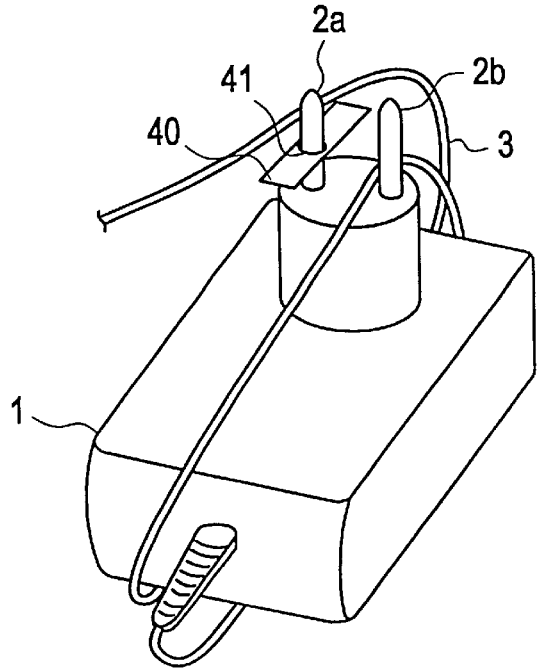
FIG. 1*b* shows the connector of FIG. 1*a* in a storage position.
Figure 3:
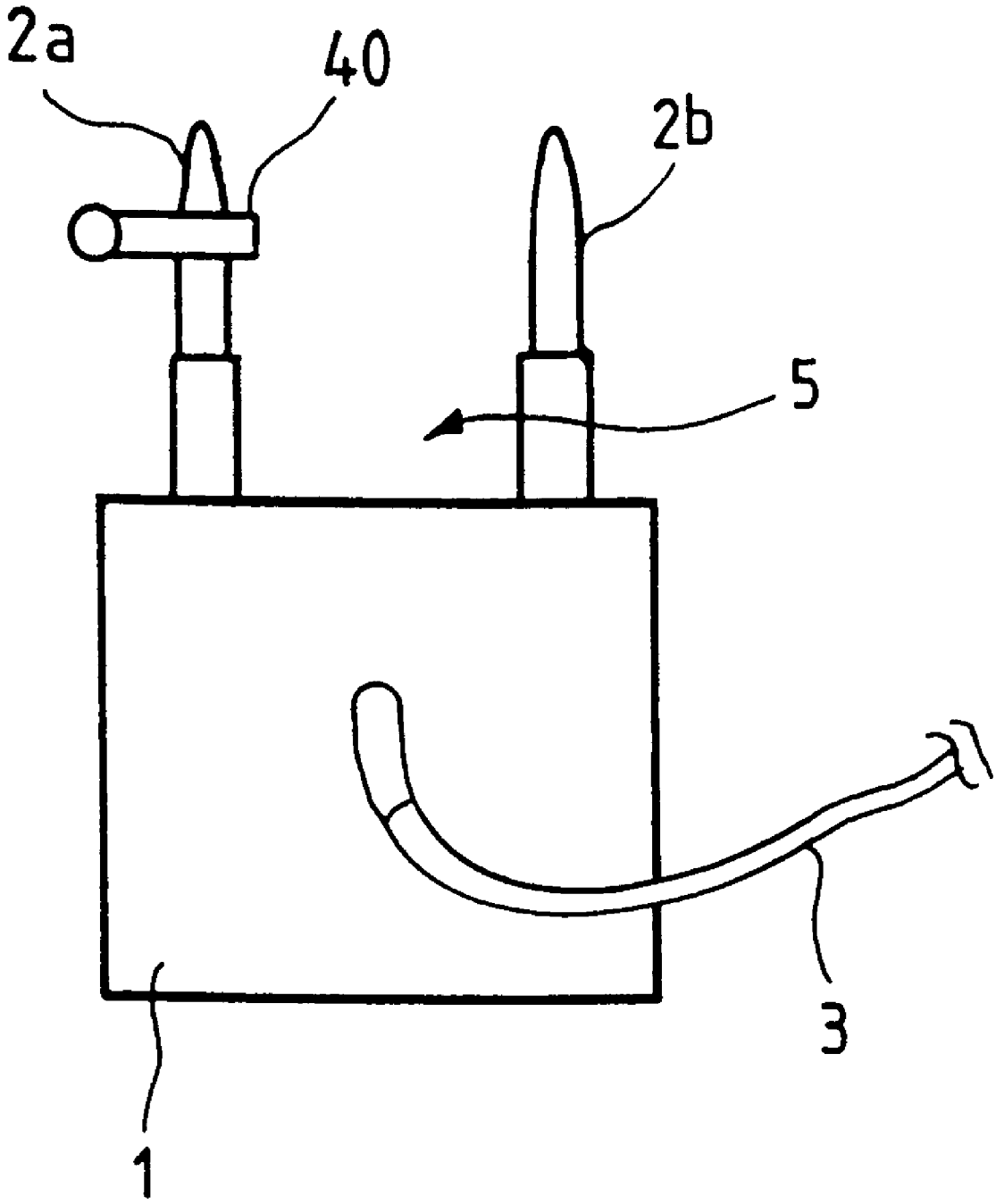
FIG. 3 is a section view of a connector according to a variant embodiment of the connector of FIGS. 1*a* and 1*b*.

In the first embodiment shown in FIGS. 1*a*, 1*b*, and 3, the fixing means 4 include a plate 40 presenting a through-hole 41 having dimensions that match the section of the pin 2*a* onto which the plate is engaged in the storage position. The size and shape of the through-hole 41 are preferably such that they enable the pin 2*a* to be inserted easily in the through-hole while preventing the plate from being removed quite so easily, thereby preventing the cable attached in this way from becoming accidentally detached from the pin 2*a*.

Since the power cable 3 is preferably wound around the housing 1 beforehand, as shown in FIG. 1*b*, the plate 40 can advantageously present at least a second through-hole (not shown) enabling fixing to be adjusted as a function of the length of the power cable 3. In this way, the cable 3 can always be attached to the pin 2*a*, even if it is not wound in the same way each time (i.e. even if it is wound tighter or looser).

Figure 2A:
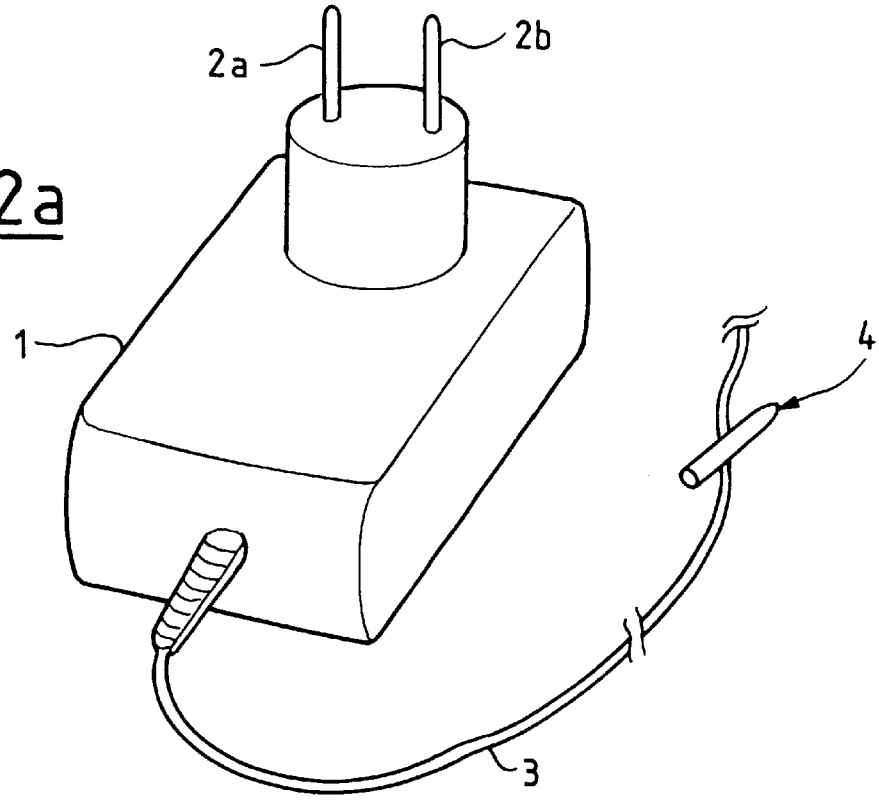
FIG. 2*a* shows a second embodiment of a connector of the invention, in which the connector is in a working position.
Figure 2B:
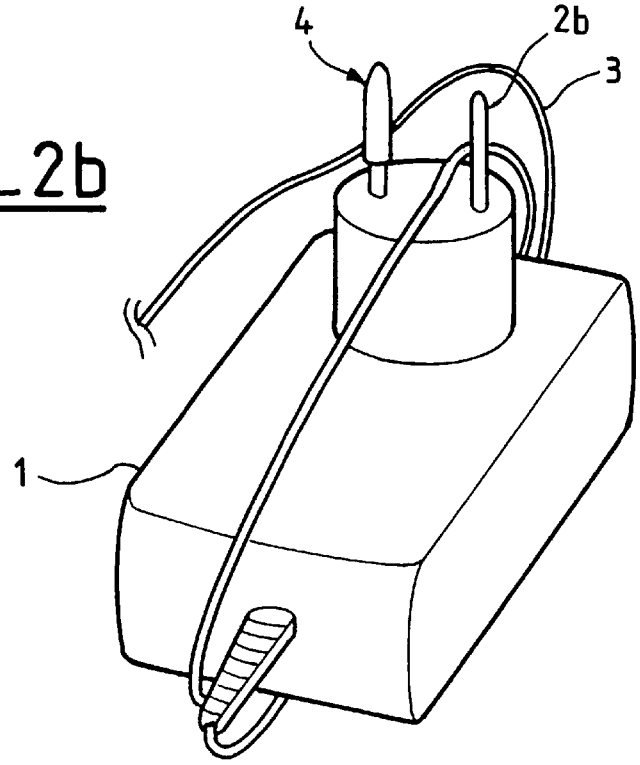
FIG. 2*b* shows the connector of FIG. 2*a* in a storage position.

In the second embodiment shown in FIGS. 2*a* and 2*b*, the fixing means 4 is in the form of a cap adapted to be fixed by covering one of the two pins in said storage position. Once again, the size and shape of the cap are such that they enable the pin 2*a* to be inserted easily in the cap while preventing the cap from being removed accidentally by the user.

The fixing means 4 are shown in the figures as being fixed to the power cable 3. This can be achieved by any known fastening method (e.g. a fastening collar). Naturally, the fixing means 4 are placed as close as possible to the end of the power cable 3 remote from the end connected to the housing.

Figure 1C:
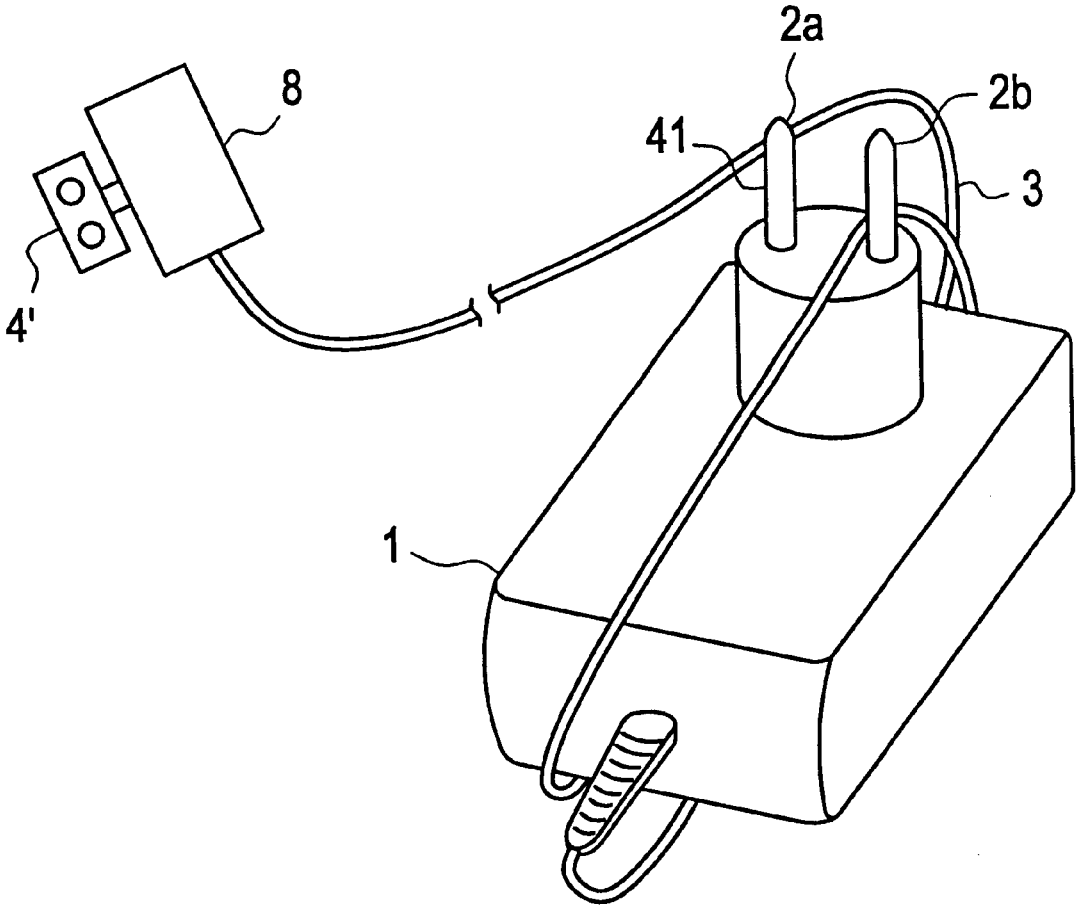
FIG. 1*c* shows a connector in accordance with an embodiment of the present invention.

It is also possible to place the fixing means at the end proper of the cable, i.e. in the case of the radio-communication terminal charger, at the electrical contact means (e.g., plug 8 or support 7) designed to connect the cable electrically to the radio-communication terminal. This embodiment enables the fixing means 4' to be integrated with the electrical contact means (as shown in FIG. 1*c*), and the manufacturing process to be simplified. (e.g. a piece obtained by molding a plastics material).

In another variant (not shown) of the invention, the fixing means are such that it can receive all of the pins of the connector simultaneously in a storage position of the connector. In the FIG. 1*a* connector, this would entail having two through-holes that are spaced apart by a distance that is identical to the distance separating the two pins 2*a*, 2*b*, and in the FIG. 2*a* connector, this would entail having two caps that are also spaced apart by a distance that is identical to the distance separating the two pins 2*a*, 2*b*.

The mold designed to manufacture the housing 1 is advantageously such that the pins 2*a*, 2*b* extend substantially parallel and are separated along their entire length starting from the housing 1 by a gap 5 so as to enable a maximum amount of said power cable 3 to be wound around said housing 1 between the two pins 2*a*, 2*b*, as shown in FIG. 3.

As a result of the invention, winding and fixing the power cable following manufacture of the connector can be easily automated. Furthermore, the user is provided with simple and reliable means for storing and transporting the connector.

Naturally, the invention is not limited to the radio-communication terminal chargers, and it also applies, in particular, to any type of connector including a housing supporting pins, and a power cable connected at its other end to a plug or to an electrical appliance.

What is claimed is:

1. A connector for an electrical appliance, the connector comprising a housing supporting at least a pair of male pins designed to be electrically connected to conductive wires of a female socket, and a power cable, the connector carrying fixing means for fixing the power cable, which fixing means are suitable for receiving at least one of said male pins when the connector is in a storage position; and wherein said fixing means includes a plate presenting a through-hole having dimensions that match a section of the at least one of the male pins onto which the plate is engaged in said storage position.

2. A connector according to claim 1, wherein said plate presents at least a second through-hole enabling fixing to be adjusted as a function of the length of the power cable.

3. A connector according to claim 1, wherein said pins extend substantially parallel and are separated along their entire length starting from the housing by a gap so as to enable a maximum amount of said power cable to be wound around said housing between the two pins.

4. A connector according to claim 1, wherein the two pins can be received simultaneously in said fixing means.

5. A connector according to claim 1, wherein the fixing means is fixed to said power cable.

6. A connector for an electrical appliance, the connector comprising a housing supporting at least a pair of male pins designed to be electrically connected to conductive wires of a female socket, and a power cable, the connector carrying fixing means for fixing the power cable, which fixing means are suitable for receiving at least one of said male pins when the connector is in a storage position; and wherein said fixing means is in the form of a cap, and in the storage position, one of the two pins is removably inserted in said cap.

7. A charger for a radio-communication terminal, the charger comprising:

a connector for an electrical appliance, the connector comprising a housing supporting at least a pair of male pins designed to be electrically connected to conductive wires of a female socket, and a power cable, the connector carrying fixing means for fixing the power cable, which fixing means are suitable for receiving at least one of said male pins when the connector is in a storage position; and and electrical contact means situated at that end of said power cable which is remote from said housing, to make electrical contact between said power cable and the radio-communication terminal, wherein said fixing means form an integral part of said electrical contact means.

8. A charger according to claim 7, wherein said electrical contact means also have the function of supporting the radio-communication terminal.

9. A connector for an electrical appliance, comprising:

a housing supporting a pair of male pins for insertion into a female socket;

a power cable attached to said housing at a first end; and a coupling device attached to a section of the power cable remote from the first end and having an insertion portion, the insertion portion removably couples to one of the pair of male pins and that secures the remote section of the power cable to said one of the pair of male pins when the connector is in a storage arrangement;

and wherein said coupling device is not in electrical contact with either of said male pins.

10. The connector according to claim 9, wherein said coupling device is a plate, and wherein said insertion portion is a through-hole in said plate and in which said one of the pair of male pins is resiliently inserted when said coupling device is coupled to said one of the pair of male pins.

11. The connector according to claim 10, wherein said plate has a second through hole in which said one of the pair of male pins can be resiliently inserted when said coupling device is coupled to said one of the pair of male pins to allow for a variation in distance between said coupling device and said pair of male pins.

12. The connector according to claim 9, wherein said coupling device is in the form of a cap, and in the storage arrangement, one of said two male pins is removably inserted in said cap.

13. The connector according to claim 9, wherein said power cable has a plug connection disposed at a second end that is opposite said first end for electrically connecting to one of a radiotelephone and a support for a radio telephone.

14. A connector for an electrical appliance, the connector comprising a housing supporting at least a pair of male pins designed to be electrically connected to conductive wires of a female socket, and a power cable attached to said housing at a first end, the connector carrying fixing means for fixing the power cable, which fixing means are suitable for receiving at least one of said male pins when the connector is in a storage position; and wherein said power cable has a plug connection disposed at a second end that is opposite said first end for electrically connecting to one of a radiotelephone and a support for a radio telephone.

15. A stowed connector for an electrical appliance, comprising:

a housing supporting a pair of male pins for insertion into a female socket;

a power cable attached to said housing at a first end and wound around the housing; and a coupling device attached to a section of the power cable remote from the first end and having an insertion portion, the insertion portion removably coupled to one of the pair of male pins so as to secure the remote section of the power cable to said one of the pair of male pins while the connector is stowed.

* * * * *